US009089194B2

(12) United States Patent
Tessier

(10) Patent No.: US 9,089,194 B2
(45) Date of Patent: Jul. 28, 2015

(54) MOBILITY ASSISTANCE DEVICES

(75) Inventor: Paul Tessier, Lynnfield, MA (US)

(73) Assignee: Technology Innovators Inc., Lynnfield, MA (US)

( * ) Notice: Subject to any disclaimer, the term of this patent is extended or adjusted under 35 U.S.C. 154(b) by 513 days.

(21) Appl. No.: 13/212,839

(22) Filed: Aug. 18, 2011

(65) Prior Publication Data

US 2012/0042918 A1 Feb. 23, 2012

Related U.S. Application Data

(60) Provisional application No. 61/374,727, filed on Aug. 18, 2010.

(51) Int. Cl.

| | |
|---|---|
| ***A45B 1/00*** | (2006.01) |
| ***A45B 9/02*** | (2006.01) |
| ***A45B 9/04*** | (2006.01) |
| ***A61H 3/02*** | (2006.01) |
| *A61H 3/04* | (2006.01) |

(52) U.S. Cl.

CPC ... *A45B 1/00* (2013.01); *A45B 9/02* (2013.01); *A45B 9/04* (2013.01); *A61H 3/04* (2013.01); *A61H 2003/0205* (2013.01); *A61H 2003/0272* (2013.01)

(58) Field of Classification Search

CPC .... A45B 1/00; A45B 9/04; A61H 2003/0272; A61H 3/0244; A61H 2003/0205

USPC ..... 135/65, 75, 77, 74, 76, 69, 66, 70

See application file for complete search history.

(56) References Cited

U.S. PATENT DOCUMENTS

| | | | | | |
|---|---|---|---|---|---|
| 4,091,828 | A | * | 5/1978 | Jorgensen | 135/66 |
| 4,121,605 | A | * | 10/1978 | Schmerl | 135/65 |
| 4,253,479 | A | | 3/1981 | Laurent | |
| 4,474,202 | A | | 10/1984 | Blechner | |
| 4,616,668 | A | | 10/1986 | Battiston | |
| 4,700,730 | A | | 10/1987 | Samuelson et al. | |
| 4,704,749 | A | | 11/1987 | Aubert | |
| 4,782,845 | A | | 11/1988 | Chou | |
| 4,809,725 | A | | 3/1989 | Champigny | |
| 4,843,661 | A | | 7/1989 | Skibinski | |
| 4,844,107 | A | | 7/1989 | Watkins | |
| 4,869,279 | A | | 9/1989 | Hedges | |
| 4,922,560 | A | | 5/1990 | Skibinski | |
| 4,941,496 | A | | 7/1990 | Berning | |
| 4,941,708 | A | | 7/1990 | Heffner | |
| 4,964,182 | A | | 10/1990 | Schmerler | |
| 4,987,912 | A | | 1/1991 | Taylor | |
| 5,005,599 | A | | 4/1991 | Cunningham | |
| 5,013,032 | A | | 5/1991 | Baum et al. | |

(Continued)

*Primary Examiner* — David R Dunn

*Assistant Examiner* — Danielle Jackson

(74) *Attorney, Agent, or Firm* — Nelson Mullins Riley & Scarborough LLP; Anthony A. Laurentano

(57) ABSTRACT

A mobility assistance device that employs a movable handle assembly and an extension support, both of which are movable between retracted and extended positions. The handle assembly is positioned when extended above a seating surface and provides leverage for a user to use his/her hands to assist in rising. The extendable support extends from a guide element along the floor beyond the center of gravity of the device and user to prevent tipping and to provide stability. When the extendable support and handle are disposed in the retracted position, the device is used like a typical cane, walker or rollator.

6 Claims, 14 Drawing Sheets

(56) References Cited

U.S. PATENT DOCUMENTS

| | | | | |
|---|---|---|---|---|
| 5,020,560 | A | 6/1991 | Turbeville | |
| 5,133,377 | A | 7/1992 | Truxillo | |
| 5,226,439 | A | 7/1993 | O'Keeffe et al. | |
| 5,238,013 | A | 8/1993 | Battiston et al. | |
| 5,305,773 | A | 4/1994 | Browning | |
| 5,365,621 | A | 11/1994 | Blain | |
| 5,380,262 | A | 1/1995 | Austin | |
| 5,411,044 | A | 5/1995 | Andolfi | |
| 5,433,234 | A * | 7/1995 | Lapere | 135/66 |
| 5,445,174 | A | 8/1995 | Cunningham | |
| 5,449,013 | A | 9/1995 | Landers | |
| 5,460,394 | A | 10/1995 | Novi | |
| 5,465,744 | A | 11/1995 | Browning | |
| 5,499,645 | A | 3/1996 | Baliga | |
| 5,509,152 | A | 4/1996 | Kippes | |
| 5,509,432 | A | 4/1996 | Peterson | |
| 5,636,651 | A | 6/1997 | Einbinder | |
| 5,740,825 | A | 4/1998 | Brunengo | |
| 5,769,104 | A | 6/1998 | Uemura | |
| 5,775,352 | A | 7/1998 | Obitts | |
| 5,785,070 | A | 7/1998 | Block et al. | |
| 5,794,284 | A | 8/1998 | Southwell, Jr. et al. | |
| 5,794,639 | A | 8/1998 | Einbinder | |
| 5,806,548 | A | 9/1998 | Goldstein et al. | |
| 5,853,015 | A | 12/1998 | Evans | |
| 5,983,911 | A | 11/1999 | Steele | |
| 6,082,384 | A | 7/2000 | Cheng | |
| 6,099,002 | A | 8/2000 | Uchiyama | |
| 6,135,131 | A | 10/2000 | Downing | |
| 6,170,501 | B1 | 1/2001 | Cook et al. | |
| 6,206,019 | B1 | 3/2001 | Horvitz | |
| 6,244,285 | B1 | 6/2001 | Gamache | |
| 6,311,942 | B1 * | 11/2001 | Rotter et al. | 248/316.5 |
| 6,503,176 | B2 | 1/2003 | Kuntz | |
| 6,550,490 | B1 * | 4/2003 | Morton et al. | 135/66 |
| 6,651,684 | B2 * | 11/2003 | Spitzer | 135/78 |
| 6,733,018 | B2 | 5/2004 | Razon | |
| 6,860,281 | B1 | 3/2005 | Clift | |
| 6,935,353 | B2 | 8/2005 | Hawkes et al. | |
| 6,990,990 | B2 | 1/2006 | Wilensky et al. | |
| 7,243,668 | B1 * | 7/2007 | Kroeze | 135/77 |
| 7,255,120 | B2 | 8/2007 | Garza, Sr. et al. | |
| 7,360,547 | B2 | 4/2008 | Carlson | |
| 7,363,931 | B2 | 4/2008 | Weaver | |
| 7,377,285 | B2 | 5/2008 | Karasin et al. | |
| 7,484,740 | B2 | 2/2009 | Miller | |
| 7,523,950 | B2 | 4/2009 | Meyers et al. | |
| 7,540,342 | B1 | 6/2009 | Ein | |
| 7,600,523 | B1 | 10/2009 | Hawkesworth | |
| 7,624,746 | B2 * | 12/2009 | Blake | 135/65 |
| 2011/0198897 | A1 * | 8/2011 | Hosler | 297/195.11 |

* cited by examiner

MOBILITY ASSISTANCE DEVICES

RELATED APPLICATIONS

The present application claims priority to U.S. Provisional Patent Application Ser. No. 61/374,727, entitled "Mobility Assistance Devices", filed Aug. 18, 2010, the contents of which are herein incorporated by reference.

BACKGROUND

Many people suffer disabilities that make it difficult for them to move about their environment. In particular it can be difficult for these people to sit and rise; for example getting down to and up from chairs, couches, toilets, benches and beds. There is a need for devices that can assist these individuals in walking around their environment and also assist them in sitting and rising. There are many devices targeted at assisting people with disabilities but unfortunately these devices have many limitations, drawbacks and inadequacies.

Current mobility assistance devices can be grouped into seven categories as outlined below—each with their own target users and associated limitations, drawbacks and inadequacies.

Category 1: Dedicated Devices for Assisting People to Sit and Stand

Devices in this category assist individuals in sitting and standing, but do not help with walking, and are generally difficult to move, thus requiring a device at each object (chair, couch, etc.) at which an individual needs to sit and rise. Many of these devices contain a platform that goes under an object or a frame that goes around the object. Some of these devices also assist people in transferring to a walker but do not themselves provide a means to assist the person in walking. In addition, people with limited mobility are not usually able to install the devices themselves and therefore need assistance with installation. For these reasons many people who could benefit from these devices do not purchase them and simply continue to struggle.

Category 2: Devices With Passive Features to Assist People to Stand

Devices in this category add design features into a standard assistive device (cane, walker, etc.) that are intended to assist people to stand, but have limited usefulness since the features need to fit within the constraints of the original device, and usually compromise the basic utility of the device itself. For example multi-level handles may be easier to grab when rising, but provide limited area to hold the handles while walking. Likewise, surfaces for users to place their feet to anchor a walker when rising can interfere with normal operation and even cause a fall hazard.

Category 3: Devices With a Movable Support to Assist People to Stand

Devices in this category have a support that moves into place for a person to hold onto when rising. These devices have the fundamental problem that the hand support extends beyond the center of gravity of the device and/or user, which can result in the device tipping unless the user holds the device at an awkward angle, or shifts his/her weight in an unnatural way. Some of these devices are intended to rest on the seating surface of a chair or couch, but are unstable on soft cushions and may not be at the correct height to help facilitate standing.

Category 4: Weight Leveraging Lifts and Walkers

Devices in this category utilize counter balances, hydraulics, or springs in mechanisms that are intended to assist a person in sitting or rising. These devices tend to be large, expensive, and complicated items that are not appropriate for the average person needing assistance with sitting and standing, and typically find limited use for severely disabled individuals.

Category 5: Transfer Assistance Devices

Devices in this category provide assistance to a person in transferring from one object to another—for example from a wheelchair to a bed. These devices have limited functionality, and are not appropriate for the average person needing assistance with sitting and standing. The devices are typically designed for use with wheelchair bound individuals and are of no, or limited, utility for people who simply need assistance in walking and do not require a wheelchair.

Category 6: Powered Assistance Devices

Devices in this category use motors, compressed gas, or other power sources to actively raise and/or lower a person, resulting in a device that is heavy, large, and expensive, and that needs to contain, or be connected to, a power source. Thus these devices are not appropriate for the average person needing assistance with sitting and standing, and typically find limited use for severely disabled individuals and in limited environments.

Category 7: Supportive Canes

Devices in this category utilize legs, platforms, and/or supports to provide some additional stability to a cane. While these devices do provide additional support to a person for walking, the devices do not provide adequate stability or leverage to provide significant assistance to a person in sitting or standing.

As evidenced by the large number and type of devices that have been invented and that are available commercially, there is obviously a significant need for mobility assistance devices. Different types of devices suit people with different needs and different types of disabilities adding to the breath of devices. Despite the significant need, decades of invention, and numerous products being brought to market, there is currently no adequate device to both assist disabled individuals in walking around their environment and also assist them in sitting and rising.

SUMMARY OF THE INVENTION

Accordingly, it would be beneficial to have mobility assistance devices that assist the user with sitting and standing as well as walking; that are usable with hard or soft seating surfaces with or without arms; that are easy to use, e.g. without outside assistance; that are light and portable, i.e. no installation required and only one device required; that are single, integrated units, i.e. no parts to be interchanged, added, or removed and that have a familiar use-model.

In accordance with one embodiment, a device is provided that is based on a cane that incorporates an extendable and retractable support and handle. The handle extends to be above a seating surface and provides leverage for the user to use his/her hands to assist in rising. The support extends along the floor beyond the center of gravity of the device which helps prevent the device from tipping during use while concomitantly providing device stability. The support is extended by the user with a sliding mechanism. When the extendable support and handle are in the retracted position, the device is used like a typical cane.

In accordance with another embodiment, a device is provided that is based on a cane that incorporates an extendable and retractable support and handle that work or cooperate together. The handle extends to be above a seating surface and provides leverage by allowing the user to use his/her hands to assist themselves when rising from a seated position. The support extends along the floor beyond the center of gravity of the device helps prevent the device from tipping while providing stability. The support is extended automatically when the user lowers the handle. When the extendable support and handle are in the retracted position the device is used like a typical cane.

According to yet another embodiment, a device is provided that is based on a walker that incorporates extendable and retractable supports and handles. The handles extend to be above a seating surface and provide leverage for the user to use his/her hands to assist in rising. The supports extend along the floor beyond the center of gravity of the device and user to prevent tipping and provide stability. When the extendable supports and handles are in the retracted position the device is used like a typical walker.

DESCRIPTION OF DRAWINGS

The invention will be apparent from the description herein and the accompanying drawings, in which like reference characters refer to the same parts throughout the different views.

DETAILED DESCRIPTION

The illustrative embodiments of the present invention provide mobility assistance devices that assist the user with sitting and standing as well as walking; are usable with hard or soft seating surfaces, with or without arms; are easy to use and do not require the assistance of others; are light and portable; do not require installation; and have a familiar use-model.

Figure 1B:
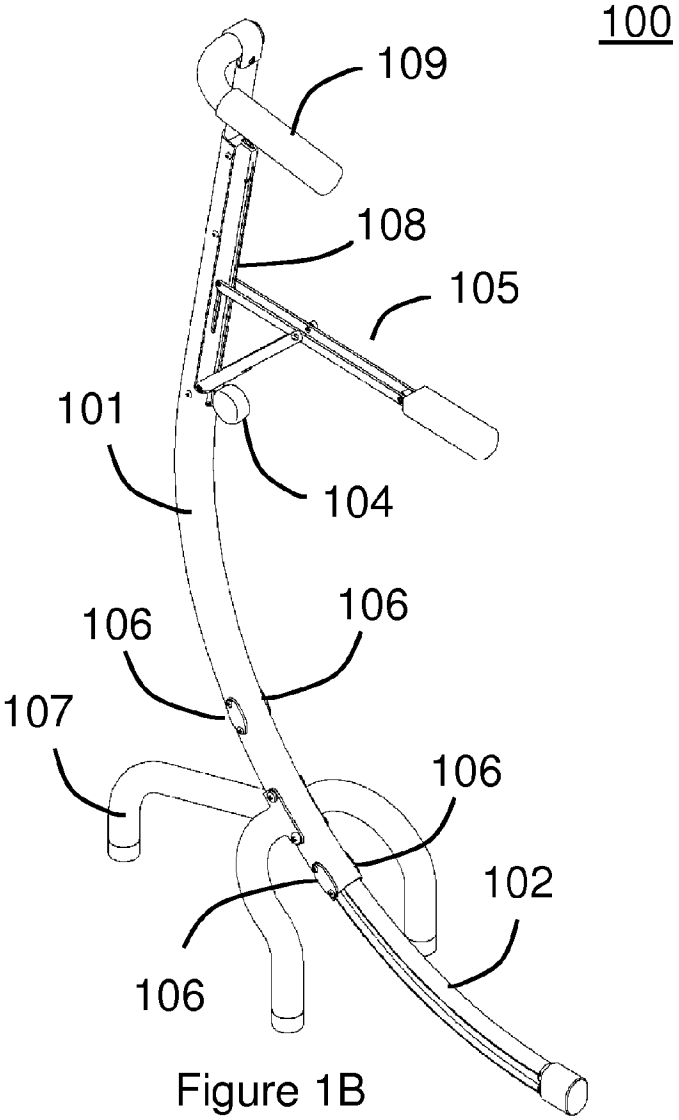
FIGS. 1A-1B illustratively depict a mobility assistance device that provides support and assistance to a user engaging in mobile activities, such as walking and rising from a seated position, according to the teachings of the present invention, and is shown with a foldable handle and extension support disposed in a retracted position, as shown in FIG. 1A, and disposed in an extended position, as shown in FIG. 1B.
Figure 1A:
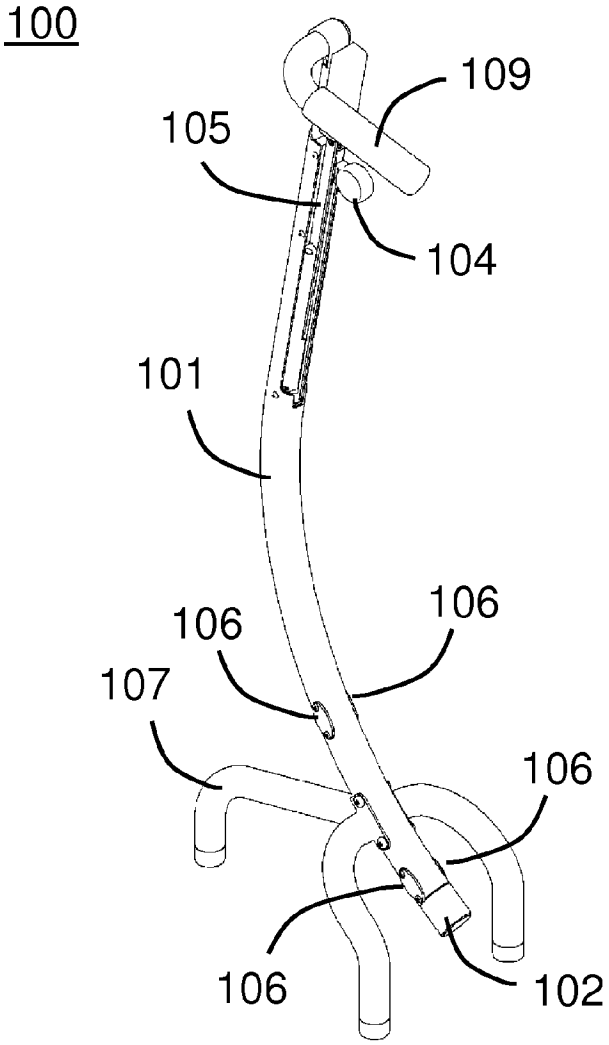

FIGS. 1A-1B, 2A-2B, 3A-3B, and 4A-4B depict different views of a first embodiment of a mobility assistance device 100 to provide mobility assistance to a user according to the teachings of the present invention. According to this embodiment, the illustrated device 100 contains a movable extension support 102 that is capable of sliding in and out of guide element or tube 101. That is, the support 102 telescopically engages the guide tube or can be frictionally fitted within the guide tube. Those of ordinary skill will readily recognize a number of different mounting and/or fastening techniques that allows the extension support 102 to move within the guide tube between different positions, such as a retracted position as shown in FIG 1A and an extended position as shown in FIG. 1B.

The guide tube 101 may be a fixed guide element. A set of bearings 106 can be coupled to the guide tube to assist the extension support 102 in moving within the guide tube 101. Alternately (not shown), the extension support 102 can slide along an outer surface of the guide tube 101 or can be telescopically mounted within guide tube 101 without requiring the use of the bearings. According to this embodiment, the extension support 102 is configured to slide rather than pivot so that the extension support 102 can move under furniture such as a chair 300 (FIG. 5B) and not interfere with the chair. If the extension support were configured to pivot up and down or extend from the side, it may hit the user or objects in the environment. A sliding or telescoping extension resolves this issue. The extension support 102 and guide tube 101 can be curved to allow the extension support 102 to transition from a mostly vertical position to a mostly horizontal position. This allows the mobility assistance device to be more compact and portable when the extension support 102 is disposed in the retracted position. Those of ordinary skill will readily recognize that the guide tube 101 and the extension support 102 can have other shapes or sizes provided that they are configured to allow the mobility assistance device of the invention to provide support and assistance to the user as contemplated herein.

Figure 2B:
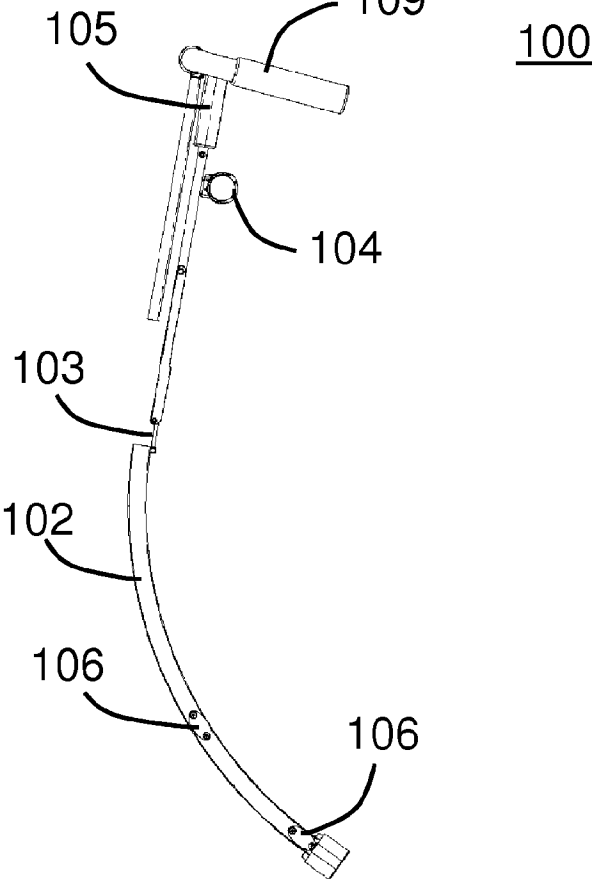
FIGS. 2A-2B depict a side view of the device of FIGS. 1A and 1B with the foldable handle and extension support disposed in the retracted position, as illustrated in FIG. 2A, and with the guide tube and support legs hidden, as illustrated in FIG. 2B, to reveal the internal components of the device.
Figure 2A:
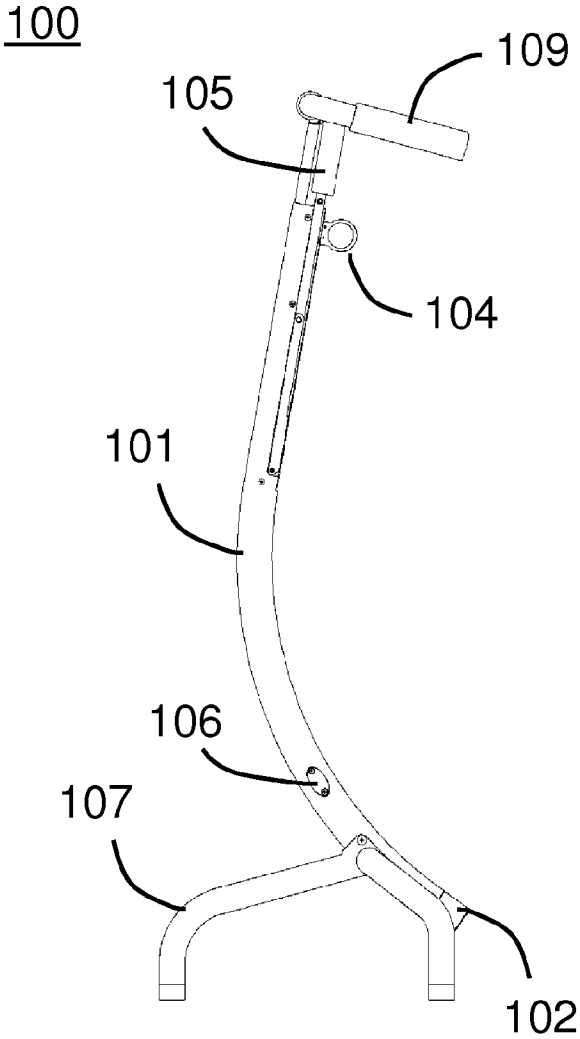
Figure 3B:
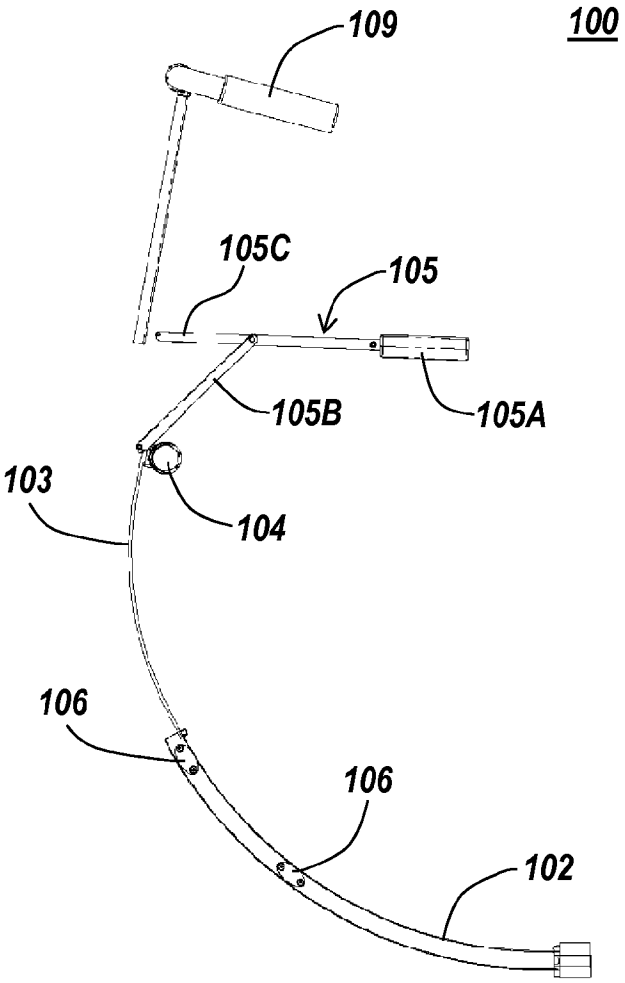
FIGS. 3A-3B depict a side view of the device of FIGS. 1A and 1B with the foldable handle and extension support disposed in the extended position, as illustrated in FIG. 3A, and with the guide tube and support legs hidden, as illustrated in FIG. 3B, to reveal the internal components.
Figure 3A:
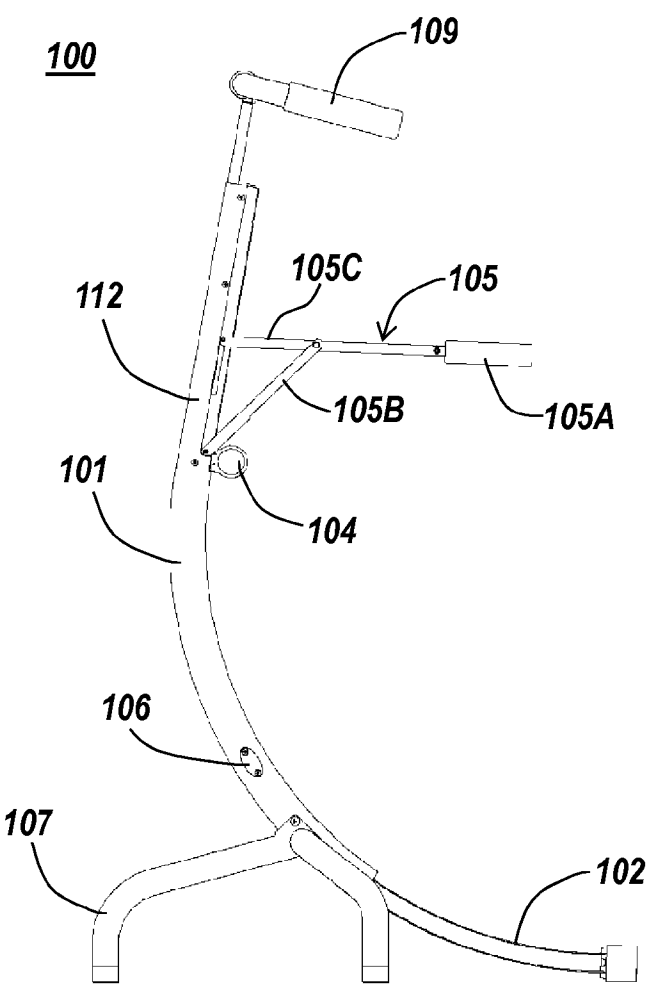
Figure 4B:
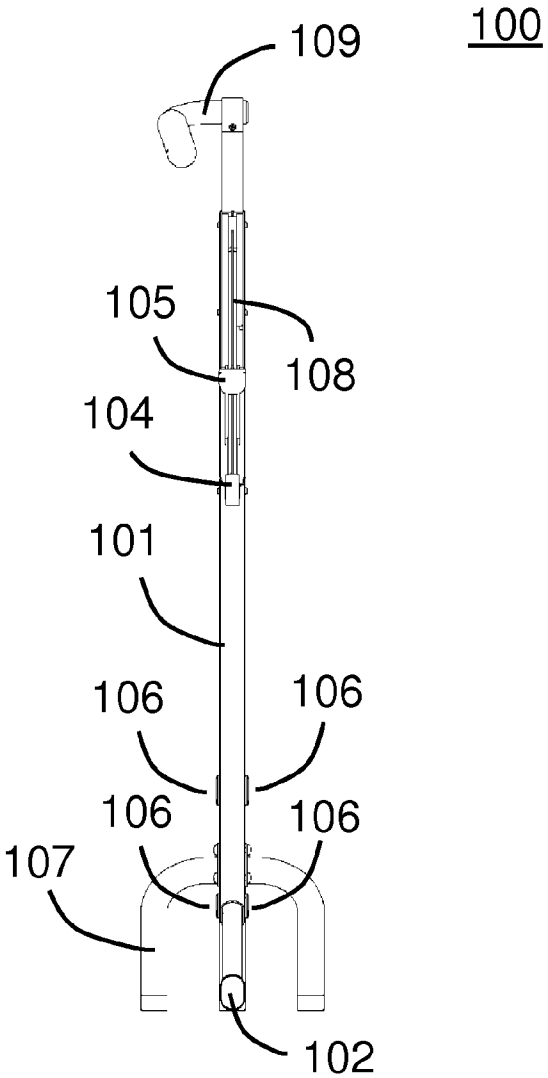
FIGS. 4A-4B depicts an end view of the device of FIGS. 1A and 1B with the foldable handle and extension support disposed in the retracted position, as illustrated in FIG. 4A, and disposed in the extended position, as illustrated in FIG. 4B.
Figure 4A:
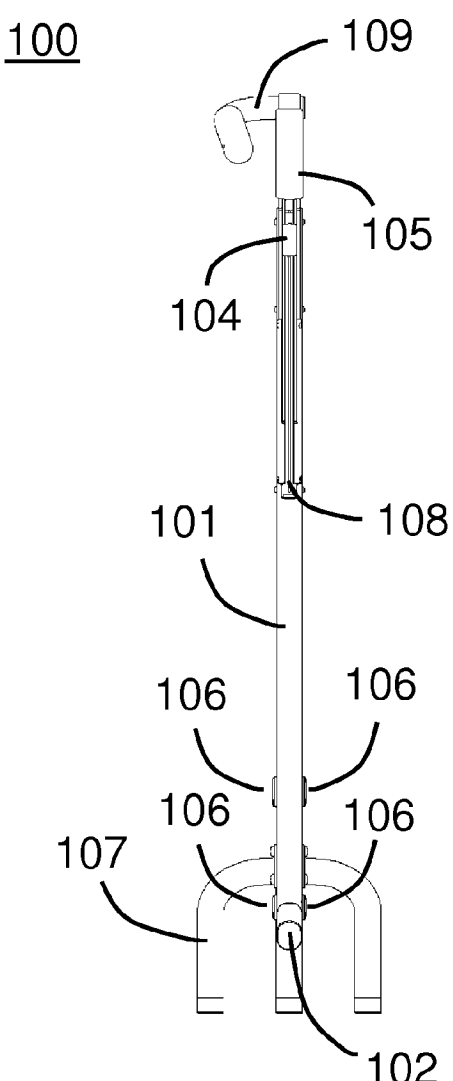

As illustrated in FIGS. 1A through 5B and in particular with reference to FIGS. 2A and 2B, the extension support 102 can be coupled or attached to one end of a flexible or bendable interconnect member 103 Which is mounted, when assembled, within or inside the guide tube 101. One end of the interconnect member is mechanically coupled by any suitable means to an end of the extension support 102. The opposed end or some other intermediate point of the interconnect member is attached to an adjustment mechanism 104 which passes through a slot 108 (FIGS. 4A and 4B) formed in the guide tube 101. The interconnect member 103 is flexible enough to conform to the shape of the curved guide tube 101 while concomitantly being stiff enough to move the extension support 102 between the retracted and extended positions. The bendable interconnect member 103 can be a single integrated or unitary structure formed for example of metal or plastic or can be a hinged assembly or one formed with linkages, According to the current embodiment, a user 200 slides the adjustment mechanism 104 along the guide tube 101 within the slot 108 which in turn moves the interconnect member 103 along the guide tube 101, thus causing the extension support 102 to move from the retracted position into the extend position. When the extension support 102 is extended from the guide tube 101, additional support is provided to the device and hence to the user 200. This additional support arises as the extended or exposed portion of the extension support 102 forms part of the base and contacts the ground when fully extended. This provides a sturdier base and allows the user to exert greater levels of pressure and force to the mobility assistance device. The adjusting mechanism 104 and the related operational. features and associated components are mechanically decoupled from the folding handle assembly 105 described below. That is, operating the adjusting mechanism so as to move the extension support 102 between the retracted and extended positions does not in turn move the folding handle assembly 105. Moreover, the adjusting mechanism is first moved to deploy the extension support 102 in order to allow the user the option of deploying the handle assembly 105.

Figure 5B:
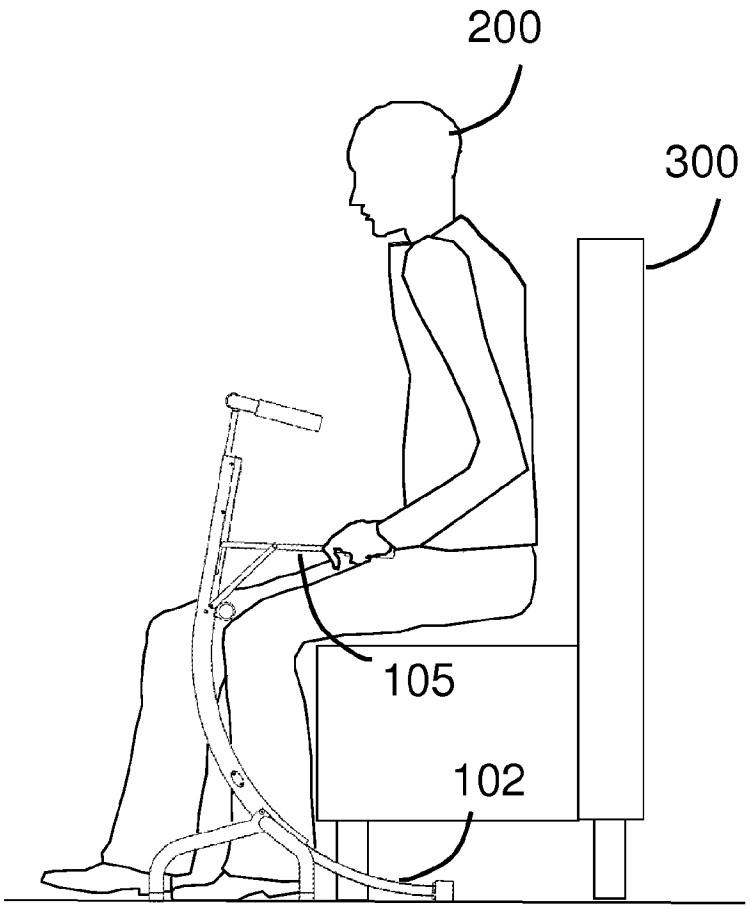
FIGS. 5A-5B depict a user using the device of FIGS. 1A and 1B according to the teachings of the present invention while walking, as illustrated in FIG. 5A, and while rising from a chair, as illustrated in FIG. 5B.
Figure 5A:
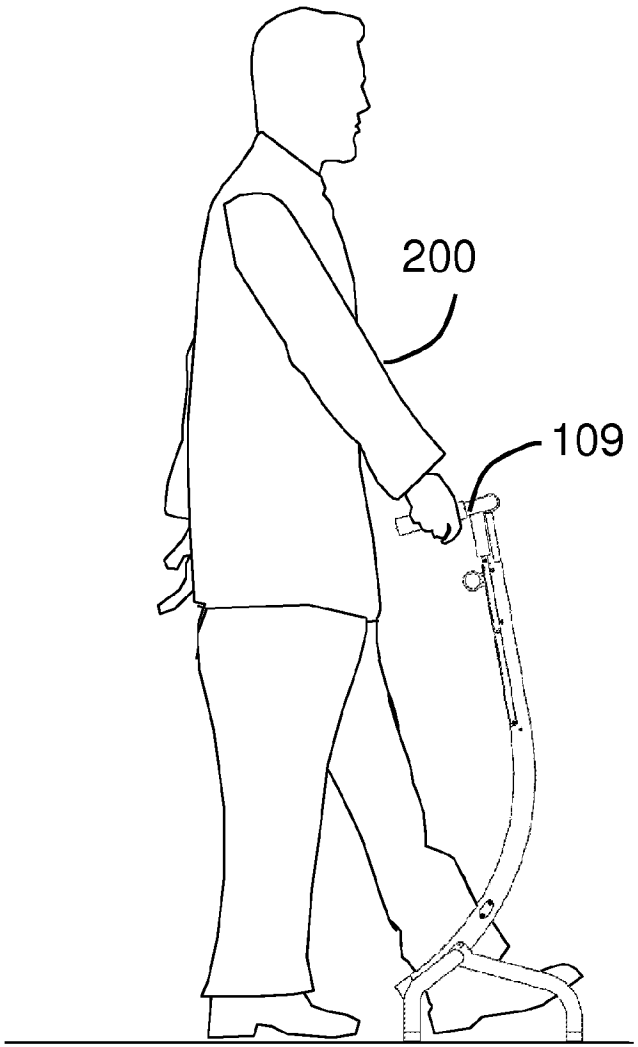
Figure 6B:
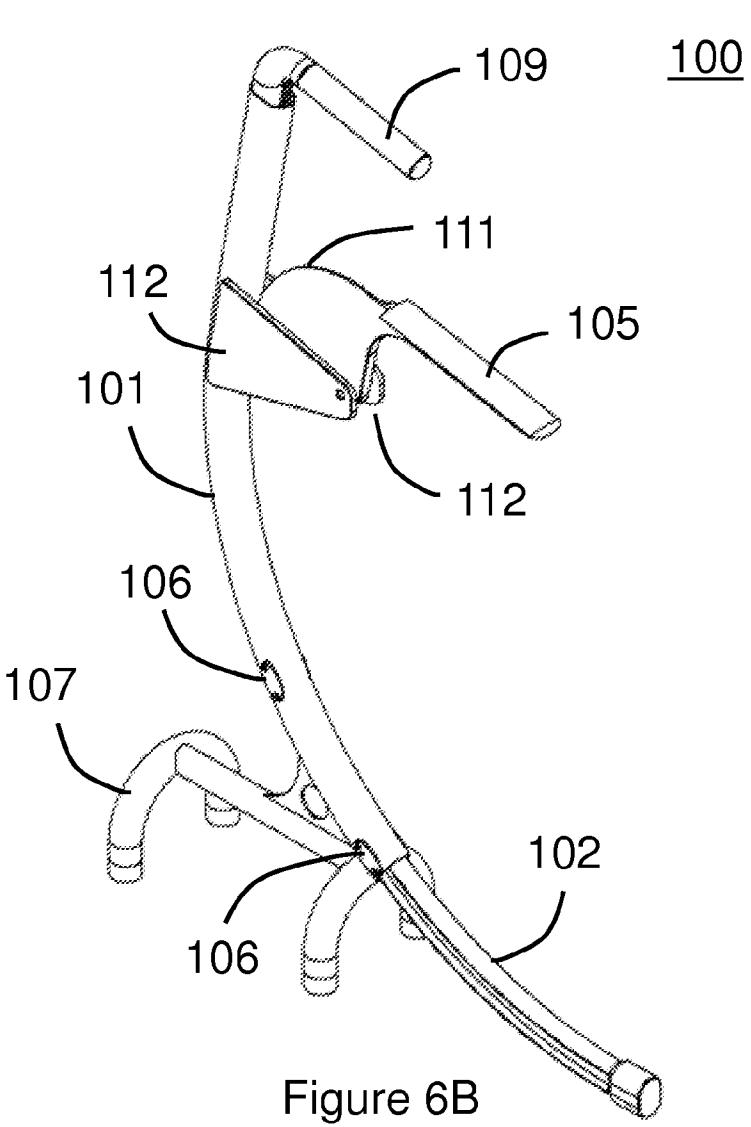
FIGS. 6A-6B depict another embodiment of the mobility assistance device according to the teachings of the present invention employing an alternate configuration for the foldable handle assembly, and illustrates the foldable handle and extension support disposed in a retracted position, as illustrated in FIG. 6A, and disposed in an extended position, as illustrated in FIG. 6B.
Figure 6A:
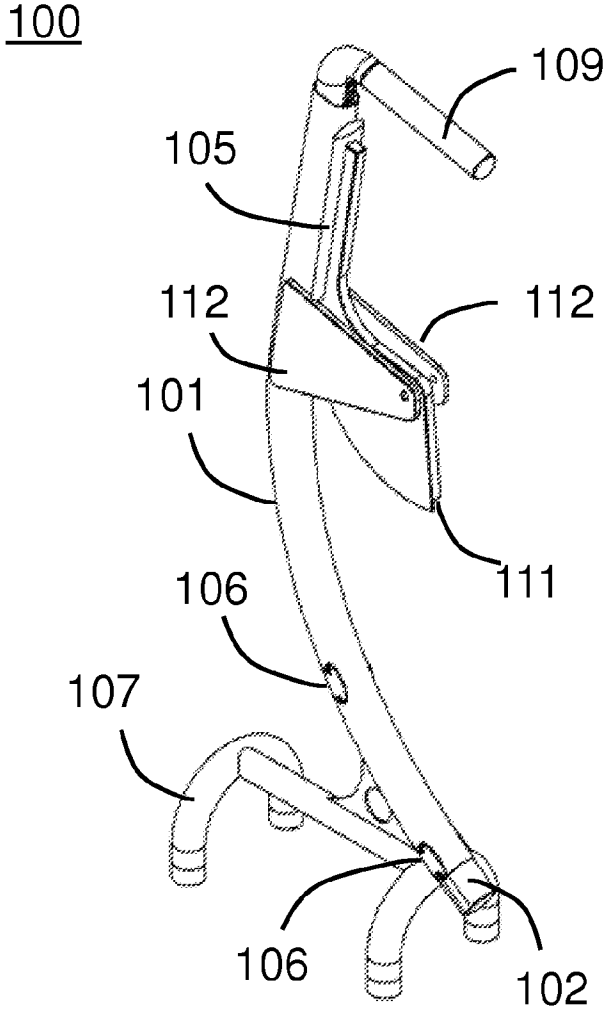
Figure 7B:
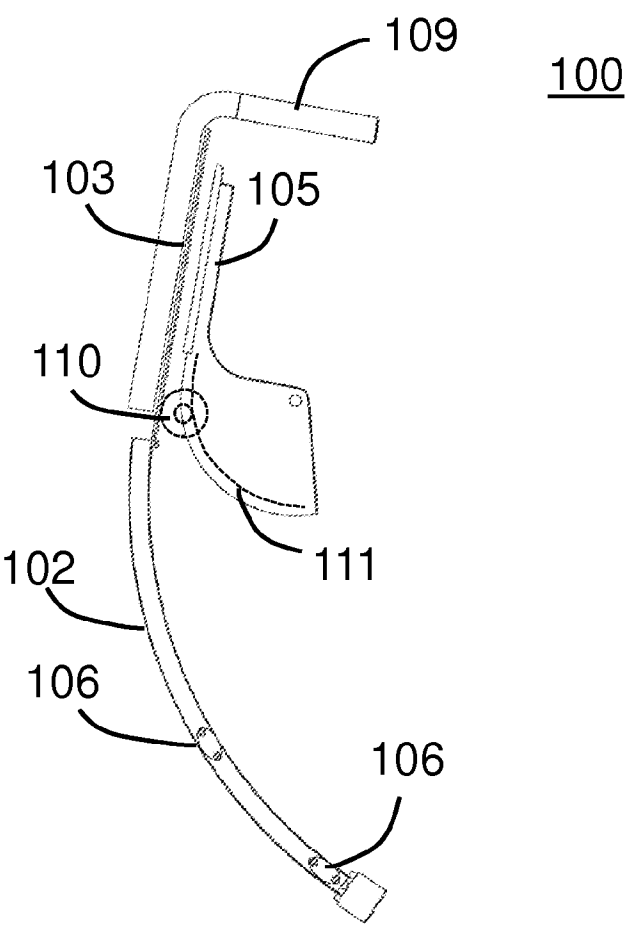
FIGS. 7A-7B depict a side view of the mobility assistance device of FIGS. 6A and 6B with the foldable handle and extension support disposed in the retracted position, as illustrated in FIG. 7A, and with the guide tube and support legs hidden, as illustrated in FIG. 7B, revealing the internal components.
Figure 7A:
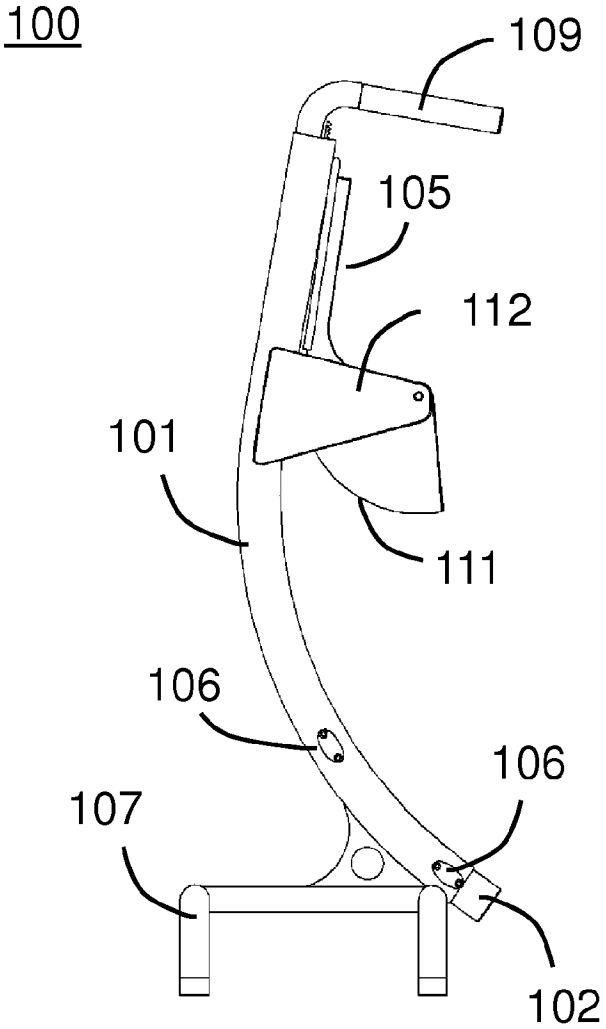

The illustrated mobility assistance device 100 also mounts at an upper end or portion thereof (i.e., at an upper end of the guide tube 101) a walking handle 109 which is held by the user 200 when walking. This upper handle 109 is separate and distinct from a foldable handle assembly 105 that is mounted at a vertically lower portion of the guide tube 101. This lower handle assembly 105 provides support for the user when lowering or raising themselves into or from a seated position. The foldable handle assembly 105 can be positioned along the guide tube 101 or away from guide tube 101. The user 200 can move the foldable handle assembly 105 into the extended (or away) position to provide a support lever to assist the user in sitting or rising. According to this embodiment, the foldable handle assembly 105 is positioned to be above the height of most common seating surfaces and below the height of walking handle 109. This positioning of the foldable handle assembly 105 provides additional support and leverage to the user 200 beyond that provided by walking handle 109 (FIGS. 5A and 5B).

The folding handle assembly 105 can comprise, according to one embodiment, the handle 105A, an intermediate support member or bracket 105B, and an extension arm assembly 105C. The intermediate support member 105B is pivotably or hingedly attached to one end of the guide tube 101 and is pivotably or hingedly attached at the other end to the extension arm assembly 105C. The extension arm assembly can include for example a pair of extension arms. The intermediate support member 105B moves in concert with the extension arm 105C and the handle 105A between the retracted and extended positions. The adjustment mechanism 104 when moved from the upper retracted position towards the lower extended position allows the handle assembly 105 to be moved away from the central axis of the guide tube towards the extended position, where the extension arm assembly 105C and the handle 105A are disposed in a position substantially perpendicular to the guide tube 101 and hence to the guide tube axis. Likewise, the intermediate support member 105B which is substantially aligned with the guide tube 101 when in the retracted position moves away from the guide tube into a stable supporting position that is transverse to both the extension arm assembly 105C and the guide tube 101. The extension arm assembly 105C extends away from the guide tube body When in the extended position and includes a pair of elongated support arms that terminate at a terminal end in the handle 105A.

Figure 14B:
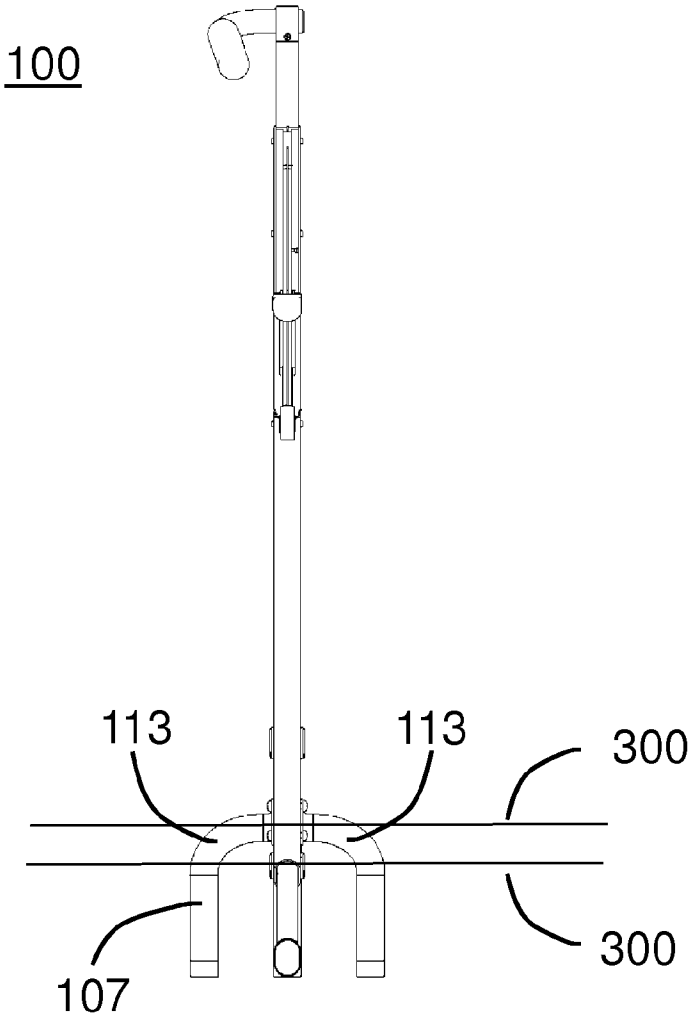
FIGS. 14A-14B depicts a side view of the mobility assistance device of FIGS. 1A and 1B contacting an object according to the teachings of the present invention, as illustrated in FIG. 14A, and an end view of the device, as illustrated in FIG. 14B.
Figure 14A:
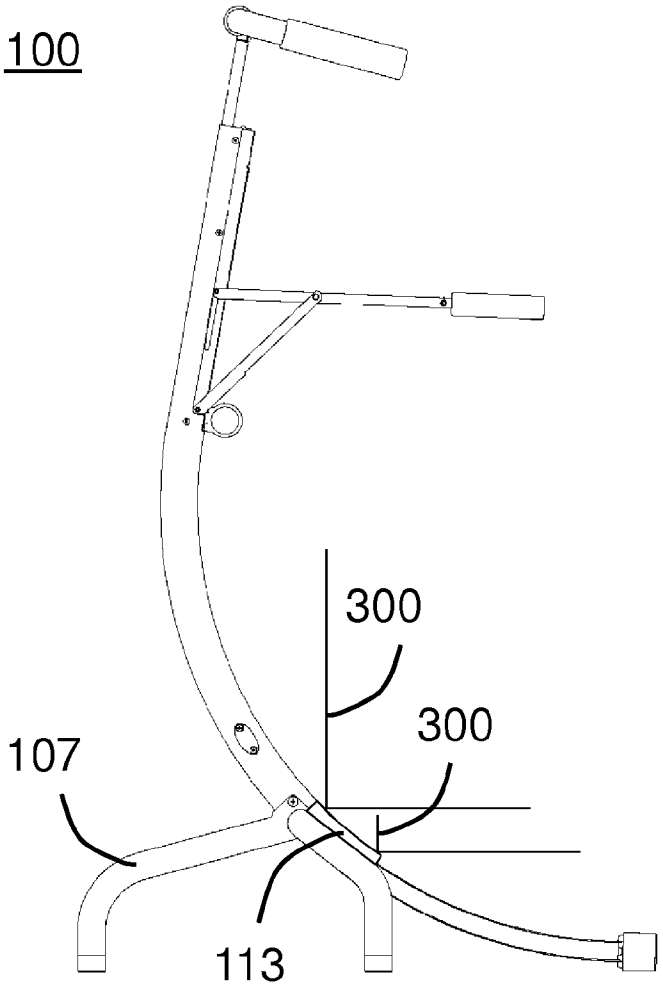

As illustrated at least in FIGS. 1A and 1B, the mobility assistance device 100 of the present invention also includes a base portion formed of a plurality of support structures 107 that provide additional support for the user 200 while concomitantly providing overall stability for the device. The support structures 107 may contain any number, type or shape of support structures with the preferred embodiment being a tripod or quad configuration of legs. According to one embodiment, the support structures 107 can be staggered from front to back and from side to side to provide stability and support in all direction. As illustrated in FIGS. 14A-14B, the one or more of the support legs provided on either side of the guide tube 101 can have contact pads 113 formed thereon. The contact pads can be formed of any material suitable for its intended purpose. For example, if the function of the contact pads are to protect objects, such as furniture, from being damaged by the device, then the pads can be formed of any material that is capable of protecting the furniture. On the other hand, if the function of the contact pads are to provide a surface that engages with the object to provide further stability to the device, then the material can be rubber or the like.

According to the present invention, the two front support legs 107 include contact portions or pads 113 that are angled so as to contact an object 300 (e.g. a bed frame) over a range of different heights of the object 300. This contact with object 300 provides additional side to side support for the device to provide mobility assistance 100. In an alternative embodiment, the support structures of support legs 107 may contact object 300 directly without the use of contact pads 113.

Figure 13:
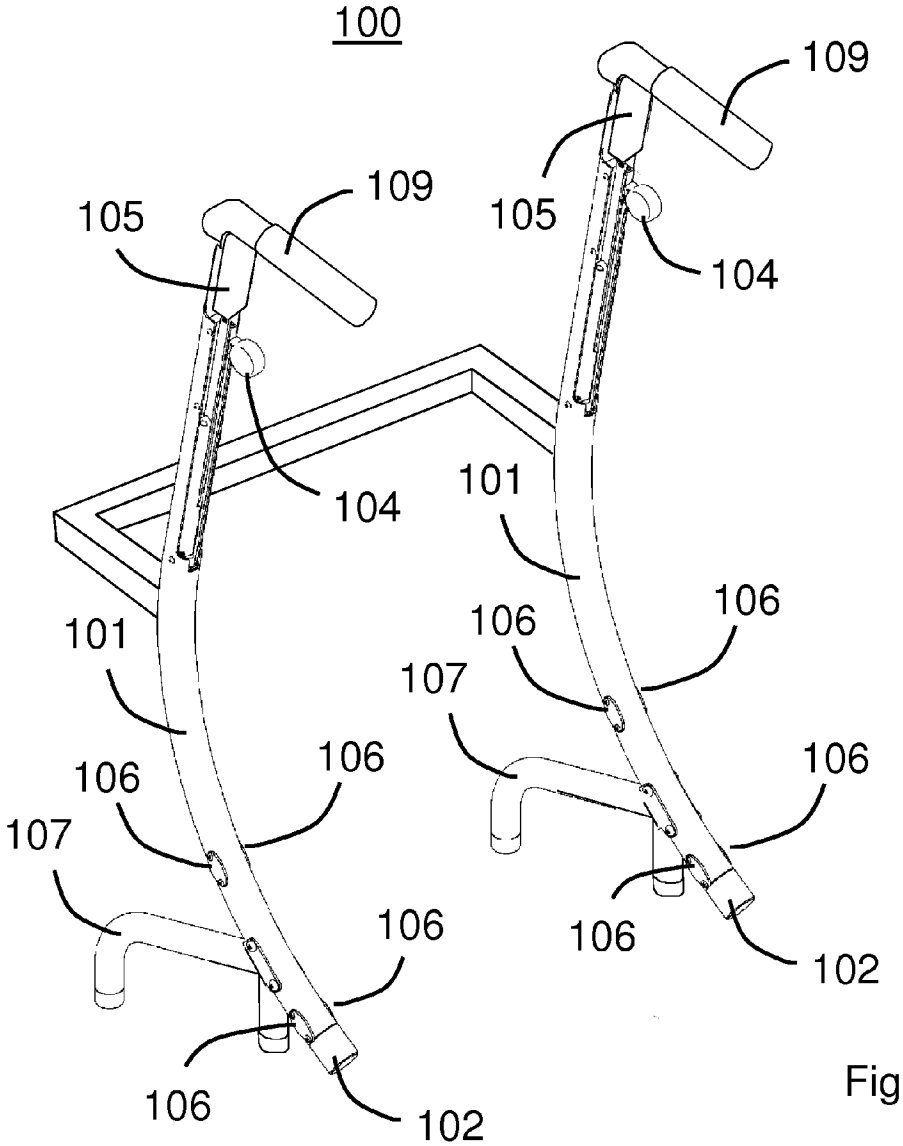
FIG. 13 is an illustrative depiction of yet another embodiment of a mobility assistance device according to the teachings of the present invention.

The mechanisms of the mobility assistance device 100 of FIGS. 1A-1B, 2A-2B, 3A-3B, and 4A-4B may also be incorporated into a walker or other form of assistance device. FIG. 13 depicts such an embodiment of a mobility assistance device 100 suitable for practicing an illustrative embodiment of the present invention which incorporates the mechanism of FIGS. 1A-1B, 2A-2B, 3A-3B, and 4A-4B into a walker. One of ordinary skill in the art will readily understand that the mechanisms described herein can be utilized in many different types of mobility assistance devices including, but not limited to; a cane, a tripod cane, a quad cane, a frame walker, or a rollator.

FIGS. 5A-5B show a user operating the mobility assistance device 100 of FIGS. 1A-4B to provide mobility assistance to the user. In the illustrative embodiment shown in FIG. 5A, the mobility assistance device 100 provides the user assistance when walking. During this type of use, the folding handle assembly 105 and the extension support 102 are disposed in the retracted position. In this embodiment, the user 200 holds the upper handle 109 and utilizes the device to provide mobility assistance like a typical tripod cane. In the illustrative embodiment shown in FIG. 5B, the device is also capable of providing assistance to the user 200 when transitioning to the seated position or when raising themselves up from the seated position. During this type of use, the folding handle assembly is moved into the extended position. In this position, the handle 105 is extended away from the body of the guide tube 101 and the extension support 102 is moved into the extended position such that it engages the ground. In this embodiment, the user 200 uses the handle 105 for leverage to sit or stand from the chair 300. The extension support 102 can extend under the chair 200 or can be positioned adjacent to the chair, and the extension support 102 prevents tipping of the device during use, and hence provides additional stability to the device and to the user.

Figure 8B:
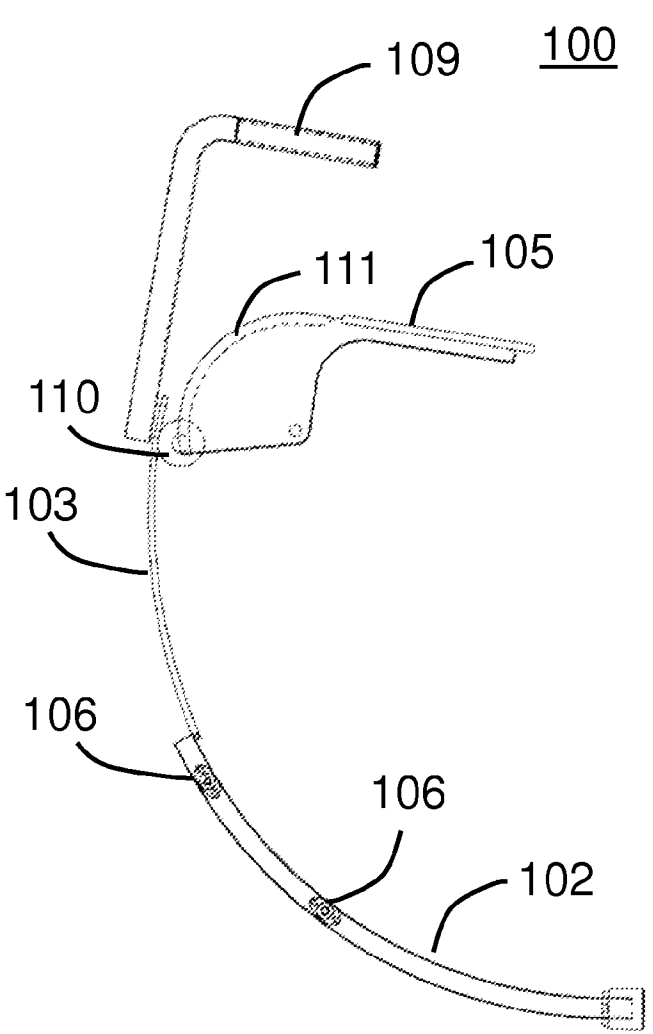
FIGS. 8A-8B depicts a side view of the mobility assistance device of FIGS. 6A and 6B with the foldable handle and extension support disposed in the extended position, as illustrated in FIG. 8A, and with the guide tube and support legs hidden, as illustrated in FIG. 8B, revealing the internal components.
Figure 8A:
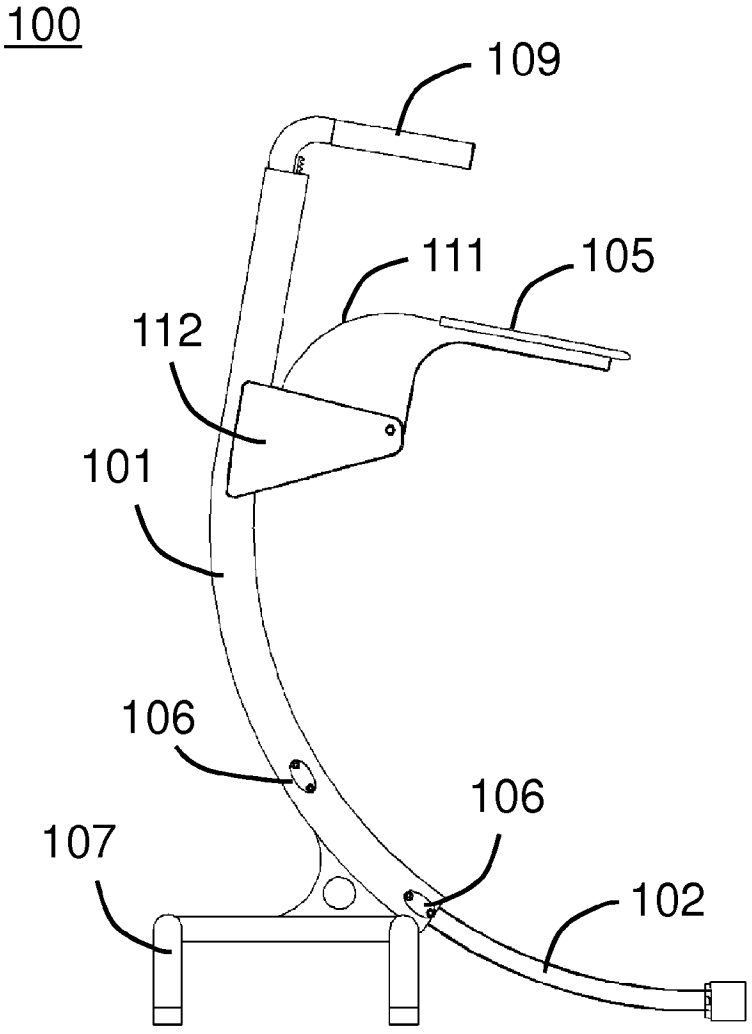
Figure 9B:
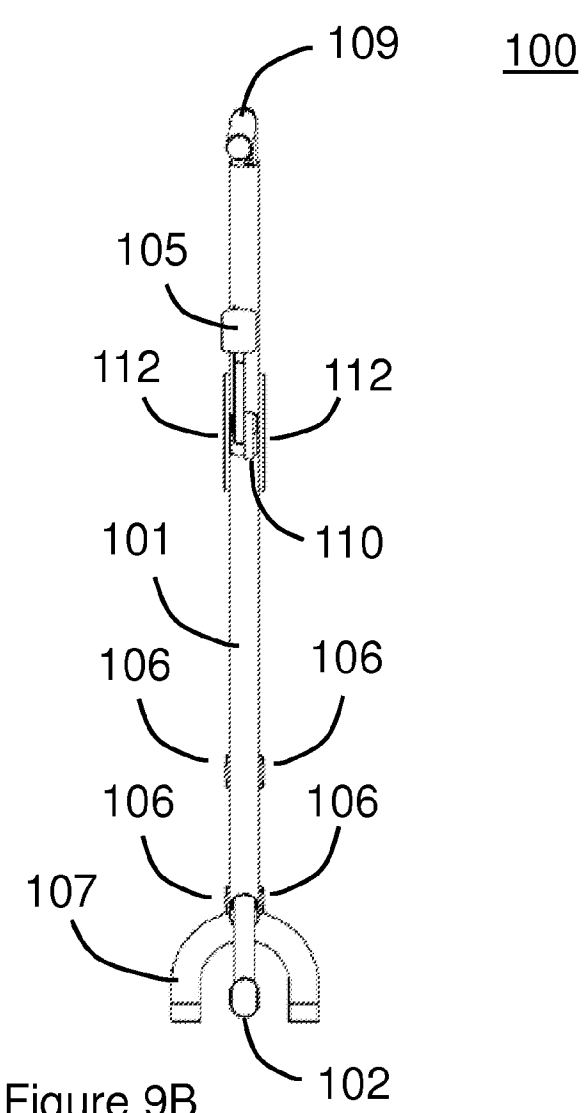
FIGS. 9A-9B depict an end view of the mobility assistance device of FIGS. 6A and 6B with the foldable handle and extension support disposed in the retracted position, as illustrated in FIG. 9A, and in the extended position, as illustrated in FIG. 9B.
Figure 9A:
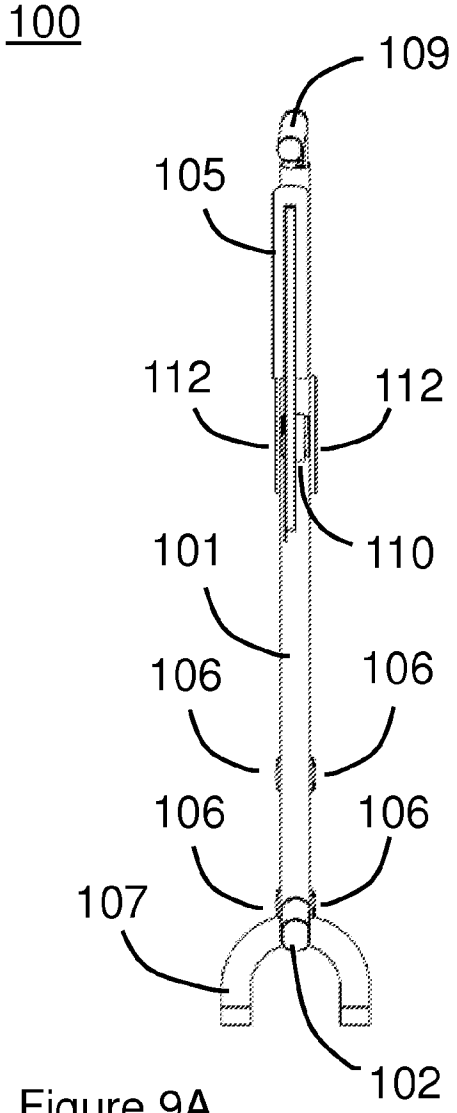
Figure 10B:
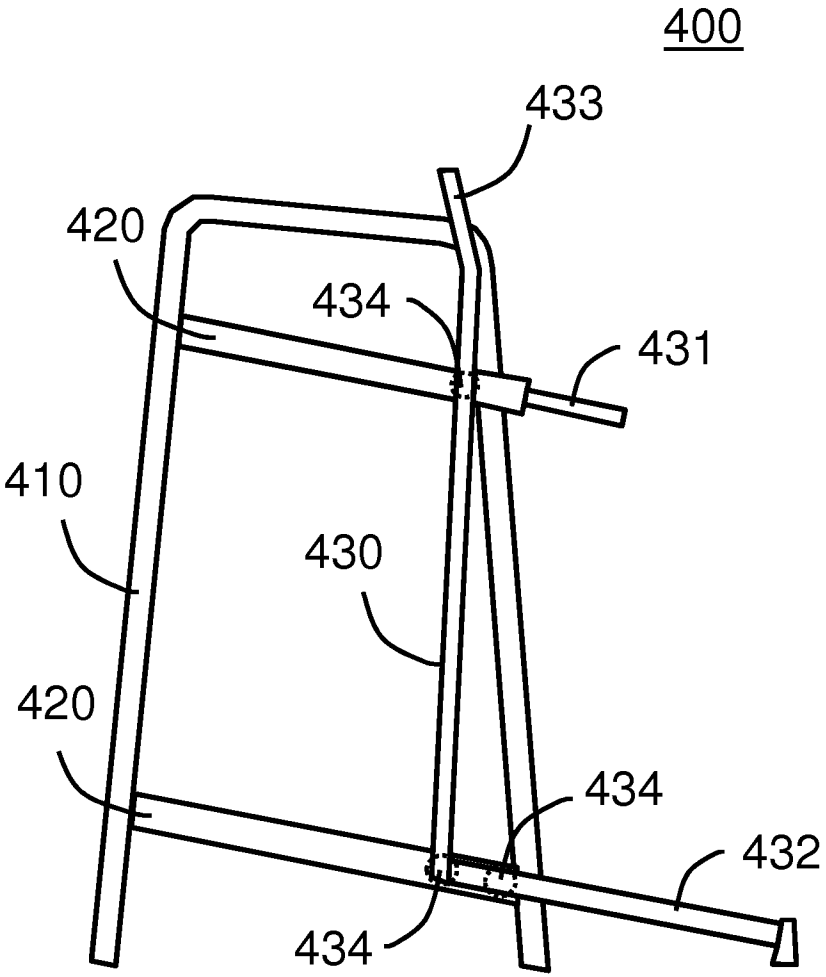
FIGS. 10A-10B depict a side view of yet another embodiment of the mobility assistance device of the present invention employing a movable extension frame assembly, and shows the extension frame assembly disposed in a retracted position, as illustrated in FIG. 10A, and disposed in an extended position, as illustrated in FIG. 10B.
Figure 10A:
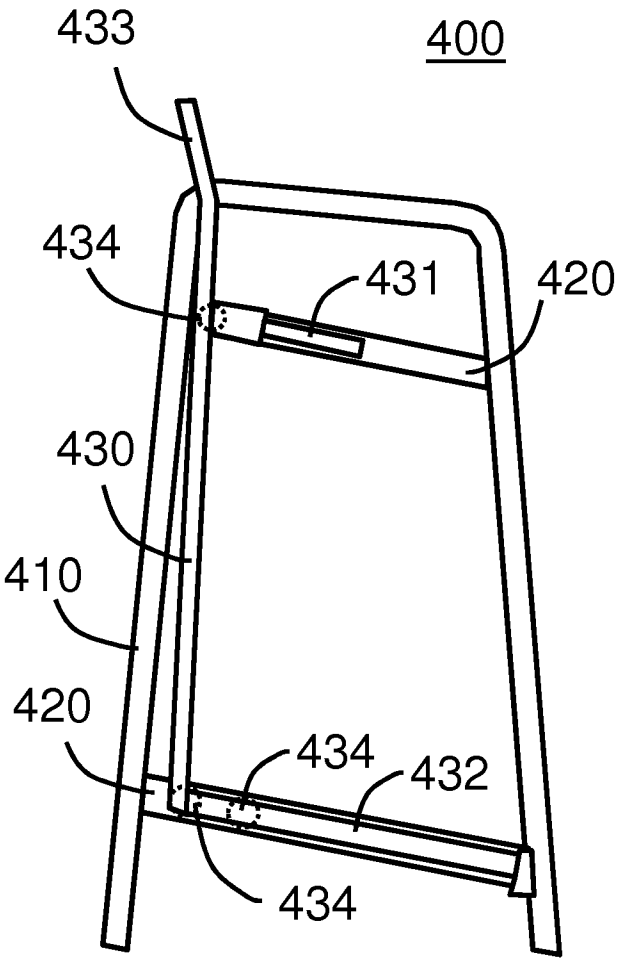
Figure 11B:
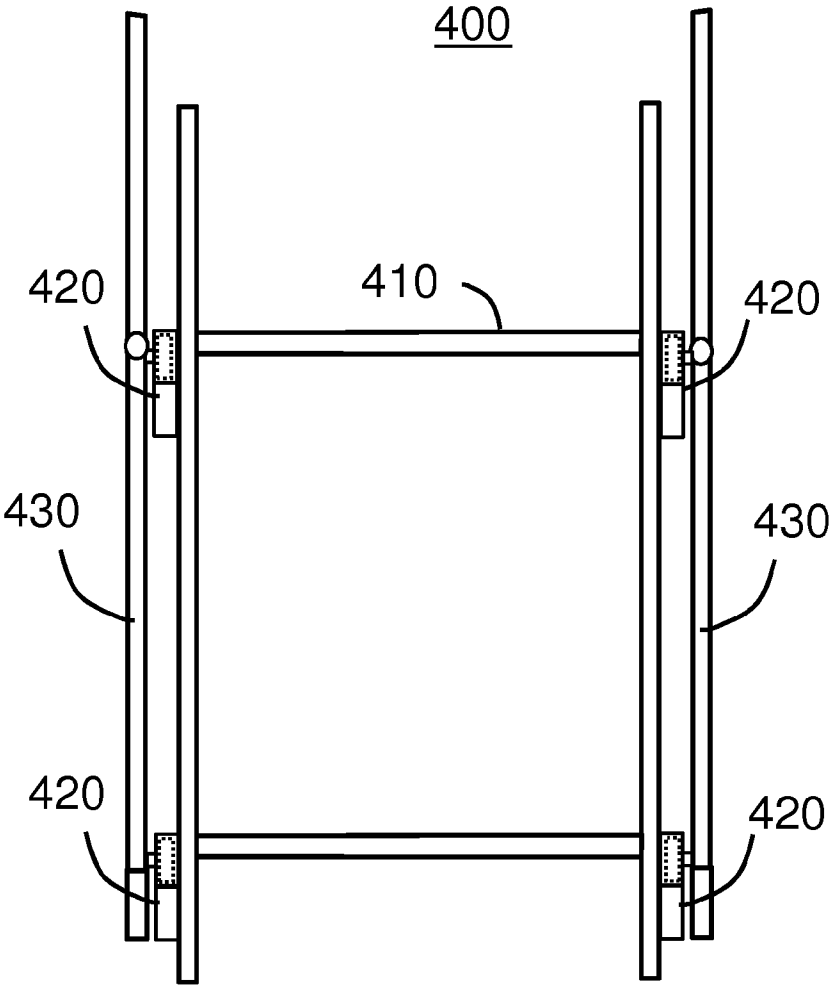
FIGS. 11A-11B depict an end view of still yet another embodiment of the mobility assistance device of the present invention, as illustrated in FIG. 11A, and a more detailed view of the sliding mechanism, as illustrated in FIG. 11B.
Figure 11A:
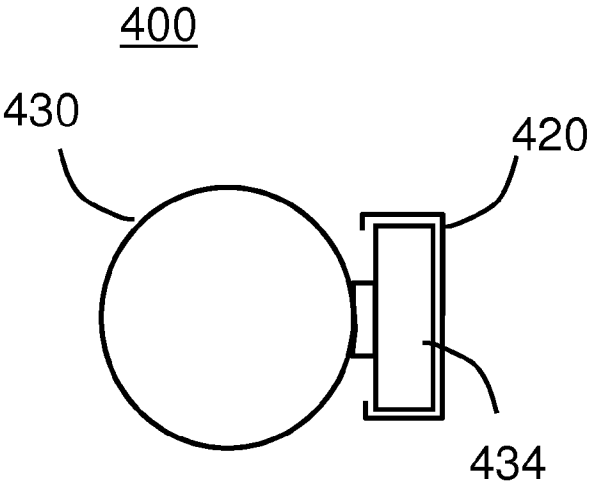

FIGS, 6A through 9B depict different views of another embodiment of the mobility assistance device 100 of the present invention, The illustrated device is similar to that of FIGS. 1A through 4B except that the folding handle assembly 105 automatically extends extension support 102 as opposed to the embodiment illustrated in FIGS. 1A through 4B. Like parts are assigned like reference numerals throughout. In the illustrated embodiment, the extension handle assembly 105 includes pair of parallel opposed handle supports 112, an extension gear 111 pivotably mounted between the handle supports, and a handle portion 113 that is connected to one end of the extension gear 111. The extension gear 111 includes a peripheral edge that has teeth that are sized and configured to mechanically engage the corresponding teeth on the gear set 110. The gear set 11.0 can be mounted within, partially within or external of the guide tube 101. The extension handle assembly 105 is mounted to the guide tube 101 and is aligned with the gear set 110. A bendable or flexible interconnect member 103 (FIG. 8B) is mounted within the guide tube. One end of the interconnect member is coupled to the extension support 102 and the opposed end is mechanically held between the handle 109 which has a portion that extends within the guide tube and an inner wall of the guide tube. The interconnect member 103 has a series of teeth that are sized and configured to engage the gear set 110 on a side of the opposite side of gear set 110 opposite to the extension gear 111. When the extension handle assembly 105 is lowered, the extension gear 11 engages the gear set 110 and rotates the gear set. The gear set 100 in turn engages the flexible interconnect member 103 and drives the member 103 in the downward direction thereby extending the extension support 102 from the guide tube 101. In this embodiment, the mobility assistance device provides mobility assistance to the user 200 in the same manner as previously described and illustrated in connection with FIGS. IA through 5B. The illustrated mobility assistance device can also be incorporated into a walker or other form of assistance device.

Similar to the previous embodiment, the mobility assistance device includes a handle assembly and extension support that are movable between the retracted position and the extended position. FIGS. 6A, 7A-7B and 9A illustrate the handle assembly and the extension support disposed in the retracted position. When the user desires to use the device to provide enhanced mobility support, the user can move the handle from the retracted position to the extended position, as shown in FIGS. 6B, 8A-8B and 9B, where the handle is disposed substantially perpendicular to the guide tube and hence to an axis of the guide tube. The handle assembly 105 when moved from the retracted position to the extended position automatically moves the extension support 102 via the gear set 100 and the extension member 113 from the retracted position, where the extension support is housed within the guide tube, to the extended position where the extension support extends from the guide tube.

Another embodiment of the mobility assistance device of the invention is shown in FIGS. 10A through 11B in the general shape of a walker. According to the illustrated embodiment, the mobility assistance device 400 includes a guide tube formed as a frame element 410 and further includes an extension frame 430 that is capable of sliding along guide channels 420 which are attached to the walker frame 410. The extension frame 430 is configured to slide rather than pivot so that the extension frame 410 can slide under furniture such as chair 300 and not interfere with the chair 300. In this embodiment, extension frame 430 is comprised of user handle 433 from which an extension handle 431 is attached, an extension support 432 is attached, and guide wheels 434 are attached. According this embodiment, a user 200 can slide extension frame 430 to extend extension handle 431 and extension support 432.

Figure 12B:
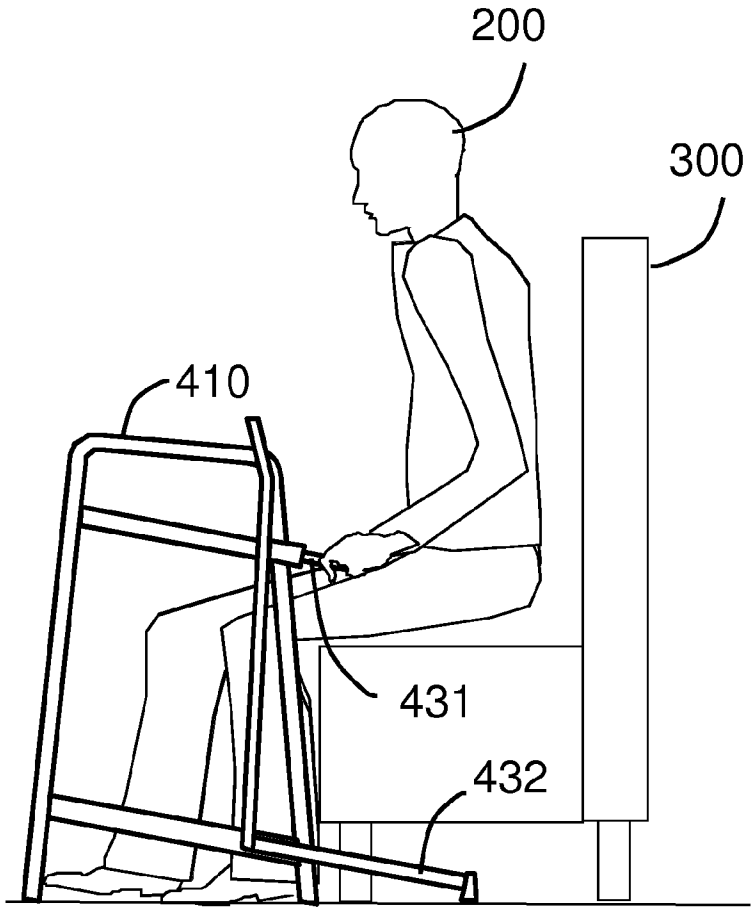
FIGS. 12A-12B depicts a user employing the mobility assistance device of FIGS. 10A and 10B according to the teachings of the present invention while walking, as illustrated in FIG. 12A, and while rising from a chair, as illustrated in FIG. 12B.
Figure 12A:
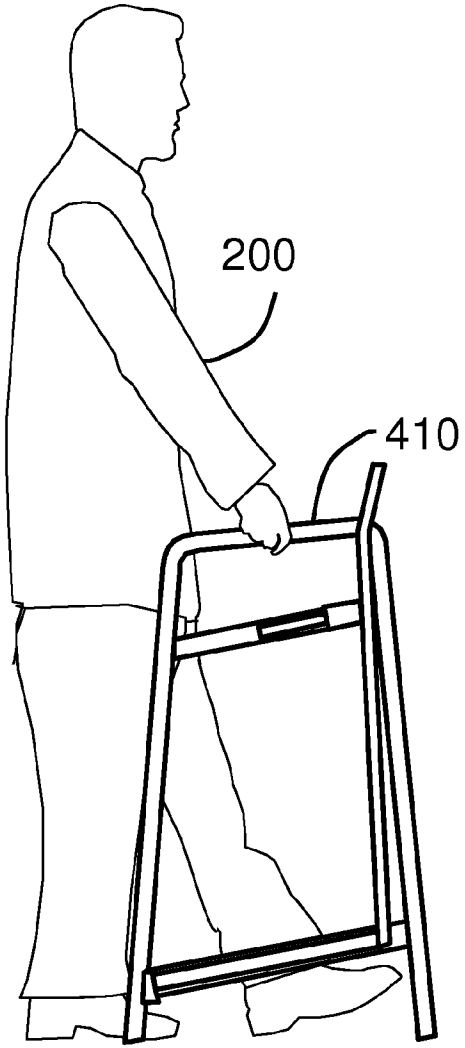

FIGS. 12A-12B show a user operating the mobility assistance device 400. In the illustrative embodiment, as shown in FIG. 12A, the device 400 is in the walking configuration with the extension frame 430 retracted along the walker frame 410. In this embodiment, the user 200 holds onto the walker frame 410 and utilizes the device to provide mobility assistance 400 like a traditional walker. In the illustrative embodiment shown in FIG. 12B, the device to provide mobility assistance 400 is in the sitting and rising configuration with extension frame 430 extended from walker frame 410. In this embodiment, user 200 uses extension handle 431 for leverage to sit or stand from chair 300. Extension support 432 extends under chair 200 prevent tipping and provide stability.

I claim:

1. A mobility assistance device, comprising:

a guide element, an upper handle coupled to a first end of the guide element to assist a user when walking;

a base having a plurality of supports connected to a second end opposite to the first end of the guide element, wherein the plurality of supports contact a walking surface and provide support for a user when walking;

a movable handle assembly adjacent the upper handle and coupled to the guide element and movable between a retracted position and an extended position, wherein the movable handle assembly when disposed in the extended position is positioned at or above a seating surface height and below the upper handle and is sized and configured to support the weight of a user during use; and an extension support coupled to an end of the guide element opposite the upper handle and mechanically decoupled from the movable handle assembly such that the extension support operates independently of the movable handle assembly, wherein the extension support is movable between an extended position and a retracted position, wherein when the extension support is disposed in the extended position the support provides stability to the device and to the user.

2. The device of claim 1, further comprising an adjustment mechanism coupled to the guide element and mounted externally thereof and is sized, configured and positioned to be directly manipulated by the user, and an interconnect member mounted within the guide element and coupled at one end to the adjustment mechanism and at an opposite end to the extension support, wherein movement of the adjustment mechanism along the guide element moves the interconnect member within the guide element, which is turn moves the extension support between the retracted and extended positions.

3. The device of claim 2, wherein the movable handle assembly is generally parallel to the upper handle and extends in substantially the same direction and comprises an extension arm assembly coupled to the guide element and movable relative thereto, an intermediate support member coupled at one end to the guide element and at the opposite end to the extension arm assembly, wherein the intermediate support member is movable relative to the guide element, and a handle coupled to an end of the extension arm assembly opposite the guide element.

4. The device of claim 1, wherein the device is a cane, a walker or a rollator.

5. The device of claim 1, wherein the guide element is formed as a frame element.

6. The device of claim 1, wherein the guide element is curved.

* * * * *